United States Patent [19]

Umeda et al.

[11] Patent Number: 4,682,673

[45] Date of Patent: Jul. 28, 1987

[54] ELEVATOR CONTROL APPARATUS

[75] Inventors: Yasukazu Umeda, Kasugai; Shintaro Tsuji, Nagoya, both of Japan

[73] Assignee: Mitsubishi Denki Kabushiki Kaisha, Japan

[21] Appl. No.: 820,222

[22] Filed: Jan. 21, 1986

[30] Foreign Application Priority Data

Jan. 21, 1985 [JP] Japan ..... 60-8671

[51] Int. Cl.[4] ..... B66B 1/20

[52] U.S. Cl. ..... 187/126

[58] Field of Search ..... 187/29; 340/19, 20

[56] References Cited

U.S. PATENT DOCUMENTS

| | | | |
|---|---|---|---|
| 3,388,376 | 6/1968 | Magee | 187/29 R |
| 4,341,288 | 7/1982 | Bass | 340/20 X |
| 4,558,298 | 12/1985 | Kawai et al. | 340/20 X |

FOREIGN PATENT DOCUMENTS

| | | | |
|---|---|---|---|
| 5244937 | 6/1975 | Japan | 187/29 R |
| 5271044 | 10/1975 | Japan | 187/29 R |
| 55-66468 | 5/1980 | Japan . | |

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

When a plurality of preset buttons among a plurality of buttons provided on a destination call registration panel have been successively depressed in a predetermined sequence and within predetermined time intervals, the presence of a request for a special operation is determined so as to register a call to a specified floor not indicated on the panel. When the request for special operation is not determined, a call to a floor corresponding to a depressed button is registeed as usual. In this manner, the destination floor call registration panel can be used for registering cage calls under normal operation and for instructing special operation without any change.

5 Claims, 5 Drawing Figures

ELEVATOR CONTROL APPARATUS

BACKGROUND OF THE INVENTION

This invention relates to an elevator control apparatus which can distinguish between special operation and call registration of an elevator.

An elevator is usually a public means of transport, and anybody can operate it merely by depressing buttons in a hall and a cage. However, it is sometimes desired that only authorized persons be able to go to certain specified floors in a building where there are, for exanple private residences.

To overcome this dilemma, a conventional elevator control apparatus such as disclosed in Japanese Patent Application Laid-open No. 55-66468, which provides means capable of performing special operations. As shown in FIG. 5, a keyboard K installed in the hall of an elevator Inlcudes a number of key buttons to register hall calls corresponding to destination floors requested by the passengers. Depending on the sequence in which the key buttons are depressed, a hall call corresponding to a specified floor is registered so that cage can be assigned to bring the passenger(s) to the specified floor. For example, when key buttons "1", "8" and "0" in the keyboard K installed in the hall of the main floor are sequentially a hall call corresponding to the fifth floor is registered. When a key button "U" is thereafter depressed, a cage is assigned to bring the passenger(s) straight to the fifth floor.

When a passenger wishes to register a cage call corresponding to a specified floor after getting into the cage, he simply depresses the key buttons on the identical keyboard installed in the predetermined sequence such as "9", "2" and "1" for the fifth floor.

According to this method, only authorized persons who know the depressing sequence of the predetermined key buttons can go to the destination floor. This provides extra security by eliminating unauthorized passengers from accessing certain floors (such as where there are private residence or restricted areas). In this known example, it is noted that the key buttons in the cage may well be used as ordinary destination floor buttons for registering cage calls.

However, the prior art is difficult to practically utilize and has the following disadvantages.

(1) In a case where the ninth floor is an ordinary floor a cage call corresponding to the ninth floor is registered when the key buttons have been depressed in the sequence of "9", "2" and "1" to request special operation to the privately specified floor. In order to avoid this, complicated arrangement must be made to ensure calls for the ordinary ninth floor are registered differently from registering calls for the specified floor having "9" in the sequence.

(2) In a case where an authorized person desires to go to a specified floor and a general (unauthorized) person rides together in the same and where the general person has depressed the key button of an ordinary floor in the course in which the authorized person is depressing the key buttons in the predetermined sequence, the depression of the key buttons in the 'predetermined sequence' is not established, and hence, the operation of the cage to the specified floor is not carried through. In this case, the key button depressed by the general person is not validated, either.

That is, when a special operation such as the operation to the specified floor by only the authorized persons is permitted to be done by the use of the ordinary destination buttons, there has been the problem that it is sometimes indistinguishable from the ordinary call registration.

SUMMARY OF THE INVENTION

This invention solves such a problem, and has for its object to provide an elevator operating apparatus which uses only ordinary destination floor buttons to ensure a low cost and which can positively distinguish requests for a special operation and ordinary call registration without inconvenience.

An elevator operating apparatus according to this invention comprises means to perform a special operation when a plurality of preset buttons are manipulated in a predetermined sequence, thereby expressing a request for the special operation, and to perform ordinary call registration when the buttons are not manipulated in that predetermined sequence, whereby ordinary service corresponding to the manipulated buttons is provided.

In this invention, whether or not the buttons have been manipulated in a predetermined sequence, is determined, and if the button manipulations do not conform to the manner, it is decided that they have manipulated for ordinary call registration.

BRIEF DESCRIPTION OF THE DRAWINGS

In the drawings, the same symbols indicate identical or corresponding portions.

PREFERRED EMBODIMENT OF THE INVENTION

Figure 1:
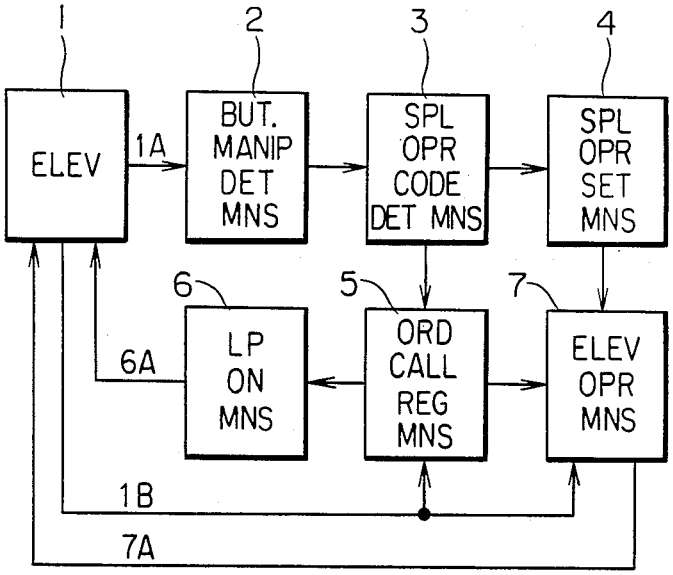
FIG. 1 is a diagram showing the whole system arrangement of an embodiment of an elevator control apparatus according to this invention.

Now, an embodiment of an elevator operating apparatus according to this invention will be described with reference to the drawings. FIG. 1 is a general arrangement diagram of the embodiment. Referring to the Fig., a button manipulation signal 1A, which indicates that a button installed in an elevator 1 has been depressed, is detected by a button manipulation detection means 2. Detection outputs of the means 2 are judged by a special operation code detection means 3 as to whether the buttons have been depressed in a preset sequence.

When the special operation code detection means 3 has detected the presence of a request for a special operation, a special operation setting means 4 functions to perform the special operation. In the absence of the request for the special operation, ordinary call registration is performed by ordinary call registration means 5, and a lamp turn-on signal 6A is delivered to the elevator 1 by a lamp turn-on means 6 so as to turn 'on' the lamp of the button.

When supplied with various operation control signals 7A by elevator operation means 7, the elevator 1 runs, a state signal 1B is transmitted to the ordinary call registration means 5 and the elevator operation means 7.

Figure 2:
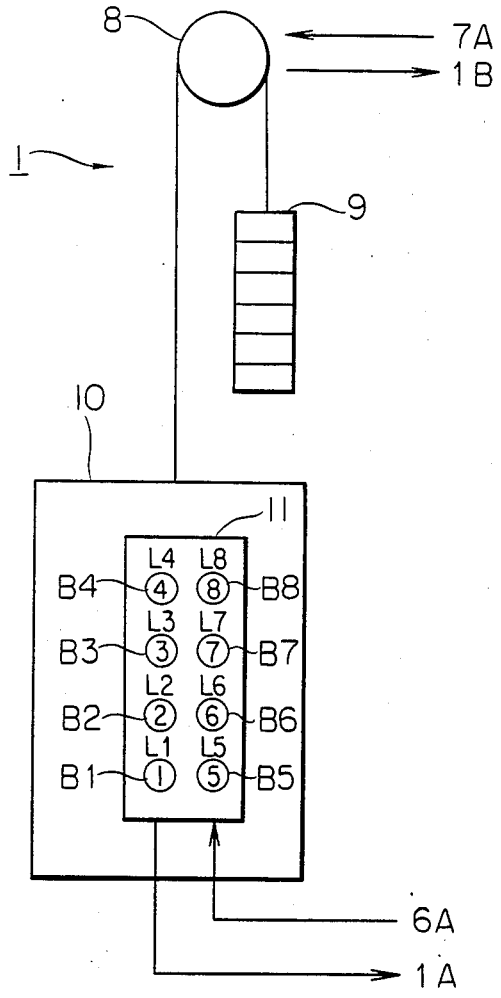
FIG. 2 is a constructional diagram of an elevator system which is applied to the elevator control apparatus of this invention.

FIG. 2 is a constructional diagram of the elevator 1 of the embodiment in FIG. 1. Refering to the Fig., numeral 8 designates a hoist, which raises and lowers a counterweight 9 and the cage 10 of the elevator in well-bucket fashion. A destination floor call registration device 11 is installed in the cage 10.

The destination floor call registration device 11 is furnished with first floor–eighth floor buttons B1-B8 with which the destinations of first–eighth floors are respectively registered, and lamps L1–L8 which are respectively disposed in the first–eighth floor buttons B1–B8.

This destination floor call registration device 11 is supplied with the lamp turn-on signal 6A, and delivers the button manipulation signal 1A as described with reference to FIG. 1. The hoist 8 is supplied with the various operation control signals 7A, and delivers the state signal 1B thereof.

Figure 3:
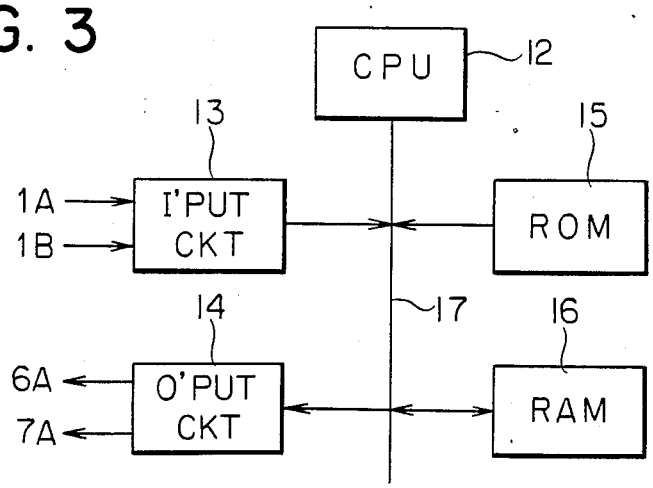
FIG. 3 is a system block diagram of portions other than the elevator in the elevator control apparatus shown in FIG. 1.

FIG. 3 is a system arrangement diagram of the various means other than the elevator 1 in the embodiment of FIG. 1, namely, the button manipulation detection means 2, special operation code detection means 3, special operation setting means 4, ordinary call registration means 5, lamp turn-on means 6 and elevator operation means 7.

Numeral 12 in FIG. 3 designates a central processing unit (hereinbelow, termed 'CPU') such as used (in microprocessors,) numeral 13 an input circuit which serves to receive the button manipulation signal 1A and the state signal 1B from the elevator 1, numeral 14 an output circuit which serves to deliver the lamp turn-on signal 6A and the various operation control signals 7A to the elevator 1, numeral 15 a read-only memory (hereinbelow, termed 'ROM') which stores a program and data for controlling this system, numeral 16 a random access memory (hereinbelow, termed 'RAM') which stores processed data, and numeral 17 a bus which connects the CPU 12, input circuit 13, output circuit 14, ROM 15 and RAM 16.

Now, the operation of the elevator operating apparatus of this invention will be described with reference to FIG. 4. This figure is a flow chart showing the operation program which is stored in the ROM 15.

In this embodiment, when the respective buttons B2, B5 and B8 of the second floor, fifth floor and eighth floor are depressed under predetermined conditions in this sequence, a call for the ninth floor, which has no corresponding button, is registered.

Figures 4, 5:
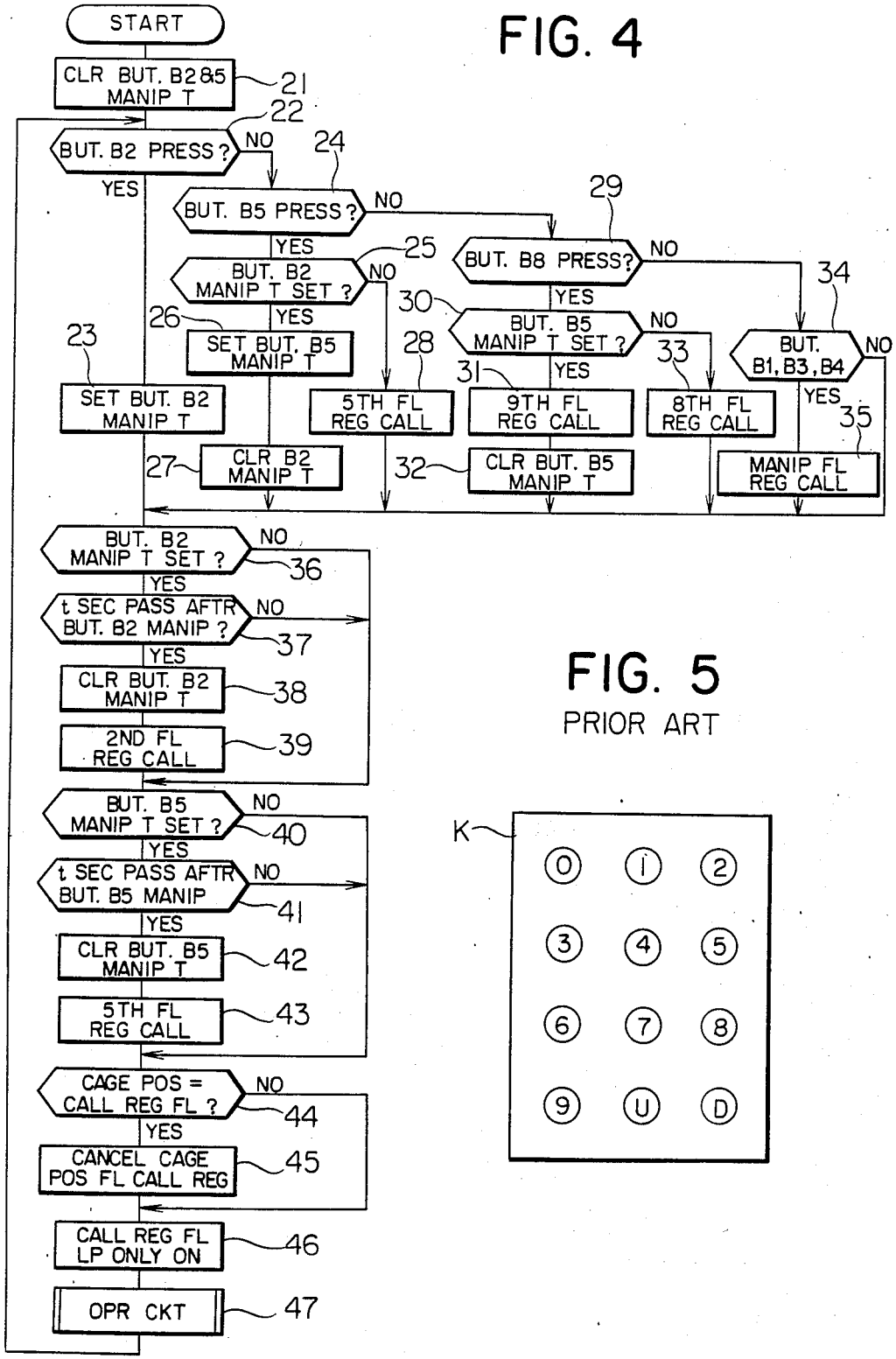
FIG. 5 PRIOR ART
FIG. 4 is a flow chart for explaining the operation of the elevator control apparatus.
FIG. 5 is a constructional diagram of a keyboard which is installed in the hall of a known elevator system.

Referring to FIG. 4, first, the manipulation times of the buttons B2 and B5 are erased at a step 21. Next, at step 22, it is determined whether or not the button manipulation signal 1A is received through the input circuit 13, i.e., the button B2 is checked at a step 22 if it has been depressed or not. In the case where the button B2 has been depressed (answer YES), the manipulation time thereof is set at a step 23, and the control flow proceeds to a step 36. The step 36, et seq. will be described later.

In a case where the button B2 has not been depressed, the control flow proceeds to a step 24, where it is determined whether or not the button B5 has been depressed. In a case where the button B5 has been depressed (answer YES), the program proceeds to step 25 where it is determined whether or not the manipulation time of the button B2 has been set. If it has been set, the manipulation time of the button B5 is set at a step 26. Next, at step 27 the manipulation time of the button B2 is erased, since it is no longer necessary. If at step 25 it is determined that the manipulation time of the button B2 has not been set, it is decided that the manipulations of buttons are not pertinent to the special operation code, and an ordinary call for the fifth floor is registered at a step 28.

In a case where the button B5 has not been depressed at the step 24, whether or not the button B8 has been depressed is checked this time at a step 29. On this occasion, if it is determined that the button B8 has been depressed (step 29) and that the manipulation time of the button B5 has been set (step 30), the special operation code has been detected. Then, the call for the ninth floor being the special operation is registered at a step 31, and the manipulation time of the button B5 is erased at a step 32.

Even when the button B8 has been depressed, the call of the eighth floor is registered at a step 33 if it is determined at step 30 that the manipulation time of the button B5 has not been set. If at step 29 it is determined that the button B8 has not been depressed, the program proceeds to a step 34, where it is determined whether or not any of the button B1, B3, B4, B6 or B7, other than the buttons B2, B5 and B8, has been depressed. In the presence of a depressed button, the call for the floor corresponding thereto is registered at a step 35.

The step 36 through a step 43 perform the ordinary call registration in a case where a preset button is not depressed within a prescribed period of time since the manipulations of the button B2 and the button B5.

Even when at step 36 it is determined that the manipulation time of the button B2 has been set, it is decided that the special operation is not requested, subject to the lapse of t seconds (for example, 2 seconds) since the above manipulation time at the step 37. Then, the manipulation time of the button B2 is erased at the step 38, and the call of the second floor is registered at the step 39. As regards the call of the fifth floor, the steps 40–43 function similarly.

If the floor where the cage 10 is presently located is the same as the call registration floor, at a step 44, it is decided that the service of the cage has been completed, and the call registration of the floor is cancelled at a step 45.

At a step 46, the lamp turn-on signal 6A of the floor whose call has been registered is delivered through the output circuit 14 so as to turn 'on' the lamp of the corresponding button. By way of example, when the call for the fifth floor has been registered, the lamp L5 is turned 'on'. It should be noted that even when the call of the ninth floor has been registered, no lamp is turned 'on'.

A step 47 corresponds to an operation circuit, which outputs the various operation control signals 7A on the basis of the state signal 1B. By way of example, it sets the direction of the cage 10 and drives a motor in accordance with the position of the cage 10 and the position of the call, and it shall not be described in detail. When the step 47 has been carried out, the control flow returns to the step 22 again.

The calculation period of time of one loop of this program should desirably be at most 100 milliseconds.

In a case where another person depresses the button B5 for the fifth floor when the special operation code has been expressed up to the buttons B2 and B5, the manipulation time of the button B2 has already been erased, and hence, the control flow proceeds along the step 22→step 24→step 25→step 28, whereby the ordinary call for the fifth floor is registered. Besides, when the button B8 is depressed within t seconds irrespective of the manipulation of the other person, the special operation can be requested.

While the destination floor call registration device 11 is installed in the cage 10 in the above embodiment, it may well be disposed in the hall of the elevator 1.

In addition, although the special operation code detection means 3 detects the special operation request when the three preset buttons have been depressed within the predetermined period of time, the present invention is not to be limited thereto. By way of example, the special operation request may well be detected when a plurality of buttons have been simultaneously depressed in excess of a predetermined period of time, or it may well be detected when one button has been depressed a predetermined number of times within a predetermined period of time.

Further, while the special operation setting means 4 functions to register the call of the ninth floor, various other functions which include, for example, establishing an independent operation, establishing an operation with an operator and preventing door closure for a predetermined period of time are considered.

As described above, this invention is so constructed as to perform a special operation when the manipulations of a plurality of preset buttons in a predetermined sequence have been detected and to perform ordinary call registration when not. Therefore, it has the effect that requests for the special operation and the ordinary call registration can be definitely distinguished at a low cost owing to the use of only ordinary destination floor buttons.

What is claimed is:

1. An elevator control apparatus comprising a destination floor call registration device installed in an elevator cage and carrying a plurality of buttons corresponding to a plurality of floors, button manipulation detection means for detecting manipulation of each of said plurality of buttons, special operation code detection means for determining the presence of a request for a special operation when manipulations of preset ones of said plurality of buttons are registered in a predetermined sequence within a predetermined period of time, special operation setting means for activating the requested special operation when said special operation code detection means has determined the presence of the request for special operation, and ordinary call registration means for performing ordinary call registration and operation when said special operation code detection means has not determined the presence of the request for special operation.

2. An elevator control apparatus according to claim 1 wherein said special operation setting means registers a call destined for a specified floor responsive to the presence of the request for special operation.

3. An elevator control apparatus according to claim 1 wherein said special operation code detection means confirms the presence of the request for special operation only wnen manipulation time intervals measured between sequential manipulations of a first and a second button and of the second and third button are within predetermined periods of time and determines the absence of the request for special operation when at least one of the measured manipulation time intervals falls outside the predetermined period of time.

4. An elevator control apparatus according to claim 3 wherein when a button different from the second button in the predetermined sequence is subsequently manipulated after the first button within the predetermined period of time, said special operation code detection means determines the absence of the request for special operation and allows said ordinary call registration means to register a call corresponding to said first button.

5. An elevator control apparatus comprising a destination floor call registration device installed in an elevator cage and carrying a plurality of buttons corresponding to a plurality of floors, button manipulation detection means for detecting manipulation of each of said plurality of buttons, special operation code detection means for determining the presence of a request for a special operation by detecting manipulations of preset ones of said plurality of buttons in a predetermined sequence, special operation setting means for activating the requested special operation when said special operation code detection means has determined the presence of the request for special operation, and ordinary call registrations means for performing ordinary call registration and operation when said special operation code detection means has not determined the presence of the request for special operation, said special operation code detection means determining the absence of the request for special operation, providing an output signal expressive of the determination, and allowing said ordinary call registration means to register a call corresponding to the manipulated button when any of the buttons other than said plurality of preset buttons in the predetermined sequence has been manipulated.

* * * * *